US008534762B2

(12) United States Patent
Linhoff et al.

(10) Patent No.: US 8,534,762 B2
(45) Date of Patent: Sep. 17, 2013

(54) ARTICULATING FOOTREST

(76) Inventors: Sam Linhoff, Roseville, MN (US); Graham Smith, Plymouth, MN (US)

( * ) Notice: Subject to any disclaimer, the term of this patent is extended or adjusted under 35 U.S.C. 154(b) by 88 days.

(21) Appl. No.: 13/396,346

(22) Filed: Feb. 14, 2012

(65) Prior Publication Data

US 2013/0207440 A1 Aug. 15, 2013

(51) Int. Cl.

| | |
|---|---|
| ***A47C 7/50*** | (2006.01) |
| ***A47C 20/00*** | (2006.01) |
| ***A47C 20/18*** | (2006.01) |

(52) U.S. Cl.

USPC ..... 297/423.26; 297/423.28; 297/423.37

(58) Field of Classification Search

USPC ..... 297/423.26, 423.28, 423.37

See application file for complete search history.

(56) References Cited

U.S. PATENT DOCUMENTS

| | | | | |
|---|---|---|---|---|
| 2,139,951 | A | 12/1938 | Gaston | |
| 2,800,164 | A * | 7/1957 | Chambers | 248/155.1 |
| 2,816,597 | A | 12/1957 | Lodvick | |
| 3,213,957 | A | 10/1965 | Wrigley | |
| 3,679,257 | A | 7/1972 | Jacuzzi | |
| 3,712,669 | A * | 1/1973 | Cates | 297/188.21 |
| 3,994,528 | A * | 11/1976 | Humphrey | 297/182 |
| 4,013,318 | A | 3/1977 | Piper | |
| 4,148,524 | A | 4/1979 | Guyton | |
| 4,358,138 | A * | 11/1982 | Laughlin et al. | 297/423.4 X |
| 4,556,252 | A * | 12/1985 | Serex | 297/423.4 |
| 4,887,826 | A | 12/1989 | Kantner | |
| 5,011,227 | A | 4/1991 | Van Hekken et al. | |
| 5,039,167 | A | 8/1991 | Sweet | |
| 5,470,038 | A * | 11/1995 | Clark | 248/156 |
| 5,480,172 | A | 1/1996 | James | |
| 5,494,334 | A | 2/1996 | Zvonik | |
| 5,529,374 | A * | 6/1996 | Wimberly, Jr. | 297/240 |
| 6,217,071 | B1 * | 4/2001 | Shia | 280/809 |
| 6,296,310 | B1 * | 10/2001 | Laudenslayer et al. | 297/344.19 |
| 6,533,360 | B1 | 3/2003 | Parkel | |
| 6,733,081 | B1 | 5/2004 | Follon | |
| 6,761,339 | B2 * | 7/2004 | Minami | 248/161 |
| 7,316,449 | B2 * | 1/2008 | Lynch et al. | 297/4 |
| 7,360,840 | B2 * | 4/2008 | Barlow et al. | 297/423.26 |
| 7,445,291 | B2 | 11/2008 | Parkel | |
| 7,496,986 | B2 * | 3/2009 | Jones | 15/246 |
| 7,611,207 | B2 | 11/2009 | Barfuss | |
| 7,850,188 | B2 | 12/2010 | Suddaby | |
| 2011/0133527 | A1 | 6/2011 | Taylor | |

* cited by examiner

*Primary Examiner* — Rodney B White

(74) *Attorney, Agent, or Firm* — Fredrikson & Byron, P.A.

(57) ABSTRACT

A stylist chair is provided that includes a chair, a center bar and a footrest assembly. The center bar couples the footrest assembly to the chair. The footrest assembly includes a gear assembly, a first pedal and a second pedal. The first pedal and the second pedal move between an open configuration and a closed configuration, wherein in the open configuration, the first pedal and the second pedal form a footrest and in the closed configuration, the first pedal and the second pedal are moved toward one another to form a configuration that enables a user to easily exit the stylist chair. Also, the first pedal and the second pedal are coupled to the gear assembly so that when one of the first pedal and the second pedal moves, the other of the first pedal and the second pedal simultaneously moves.

21 Claims, 18 Drawing Sheets

FIG. 20
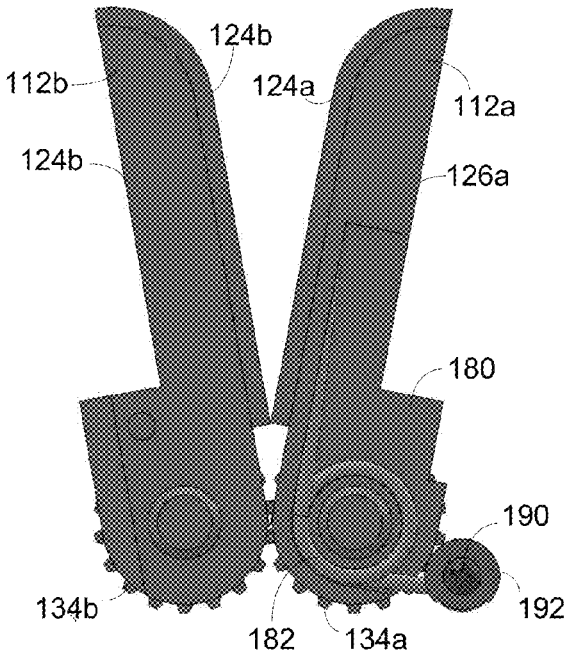
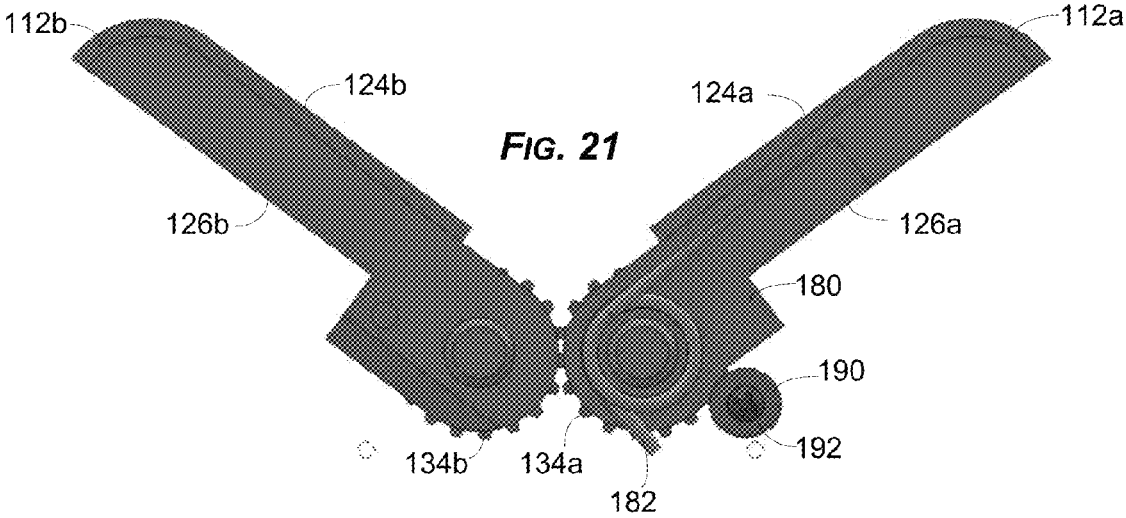
FIG. 21

ARTICULATING FOOTREST

FIELD

This application relates generally to a stylist chair and, more particularly, to an articulating footrest for a stylist chair.

BACKGROUND

Salon, stylist or barber's chairs are widely used by beauticians, stylists, barbers and other individuals for performing a service for a user seated in the chair. FIG. 1 illustrates a typical prior art stylist chair, which contains a chair 70', a center bar 50', and a footrest 10'. The footrest 10' supports a user's feet while he or she is sitting in the chair 70'. However, the center bar 50' and footrest 10' together form a "T shape" that is unmovable. The shape and location of such a footrest 10' can create a tripping hazard. For example, when disembarking from the chair, the user typically removes his/her feet from the footrest 10' and sets each foot on the ground such that the individual's legs straddle the center bar 50' and the feet are behind the footrest 10'. The individual must then spread his/her legs wider in order to step away from the chair 70' without tripping on the footrest 10'. Older people, in particular, have greater difficulty maneuvering in such a manner. Thus, it would be desirable to provide an improved footrest assembly that can be easily manipulated so that it presents less of a tripping hazard and allows for a user to easily step away from a stylist chair.

BRIEF DESCRIPTION OF THE DRAWINGS

The following drawings are illustrative of particular embodiments of the invention and therefore do not limit the scope of the invention. The drawings are not to scale (unless so stated) and are intended for use in conjunction with the explanations in the following detailed description. Embodiments of the invention will hereinafter be described in conjunction with the appended drawings, wherein like numerals denote like elements.

FIG. 20 is a front side view of a footrest assembly without a housing according to the second embodiment, wherein the footrest assembly is in a closed configuration;

FIG. 21 is a front side view of a footrest assembly without a housing according to the second embodiment, wherein the footrest assembly is in between a closed configuration and an open configuration;

SUMMARY

Figure 1:
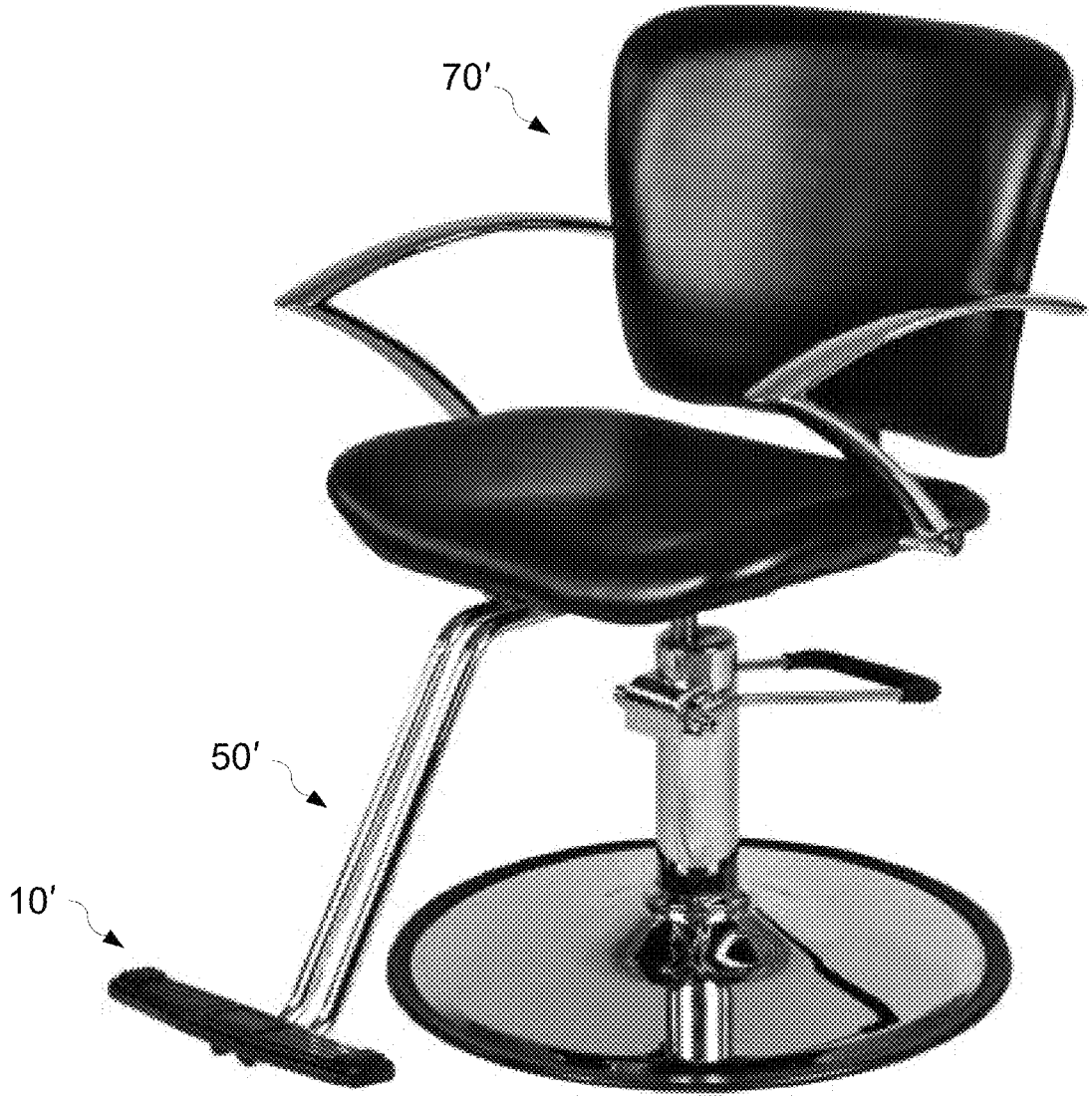
FIG. 1 PRIOR ART
FIG. 1 is a perspective view of a prior art stylist chair.

The present invention provides a footrest assembly for a stylist chair that can be easily manipulated so that it presents less of a tripping hazard and allows for a user to easily enter into and step away from the chair. The footrest assembly is coupled to a stylist chair through a central bar. The footrest assembly includes a gear assembly, a first pedal and a second pedal. The first pedal and the second pedal move between an open configuration and a closed configuration. In the open configuration, the first pedal and the second pedal are moved away from one another to form a footrest. In the closed configuration, the first pedal and the second pedal are moved toward one another to form a configuration that enables a user to easily exit the stylist chair. Also, the gear assembly is a cooperating gear assembly, so that when one of the first pedal and the second pedal moves, the other of the first pedal and the second pedal simultaneously moves.

DETAILED DESCRIPTION

For the purpose of promoting an understanding of the principles of the invention, reference will now be made to the embodiments illustrated in the drawing and specific language will be used to describe the same. It will, nevertheless, be understood that no limitation of the scope of the invention is thereby intended; any alterations and further modifications of the described or illustrated embodiments, and any further applications of the principles of the invention as illustrated therein, are contemplated as would normally occur to one skilled in the art to which the invention relates.

In the foregoing detailed description, the invention has been described with reference to specific embodiments. However, it can be appreciated that various modifications and changes can be made without departing from the scope of the invention.

FIGS. 2-10 illustrate a footrest assembly 10 according to a first embodiment. FIGS. 11-29 illustrate a footrest assembly 110 according to a second embodiment. In each embodiment, the footrest assembly includes a gear assembly, a first pedal and a second pedal. The first pedal and the second pedal move between an open configuration and a closed configuration. In the open configuration, the first pedal and the second pedal are moved away from one another to form a footrest. In the closed configuration, the first pedal and the second pedal are moved toward one another to form a configuration that enables a user to easily exit the stylist chair. Also, the gear assembly is a cooperating gear assembly, so that when one of the first pedal and the second pedal moves, the other of the first pedal and the second pedal simultaneously moves. Each the first embodiment and the second embodiment will now be described.

Figure 2:
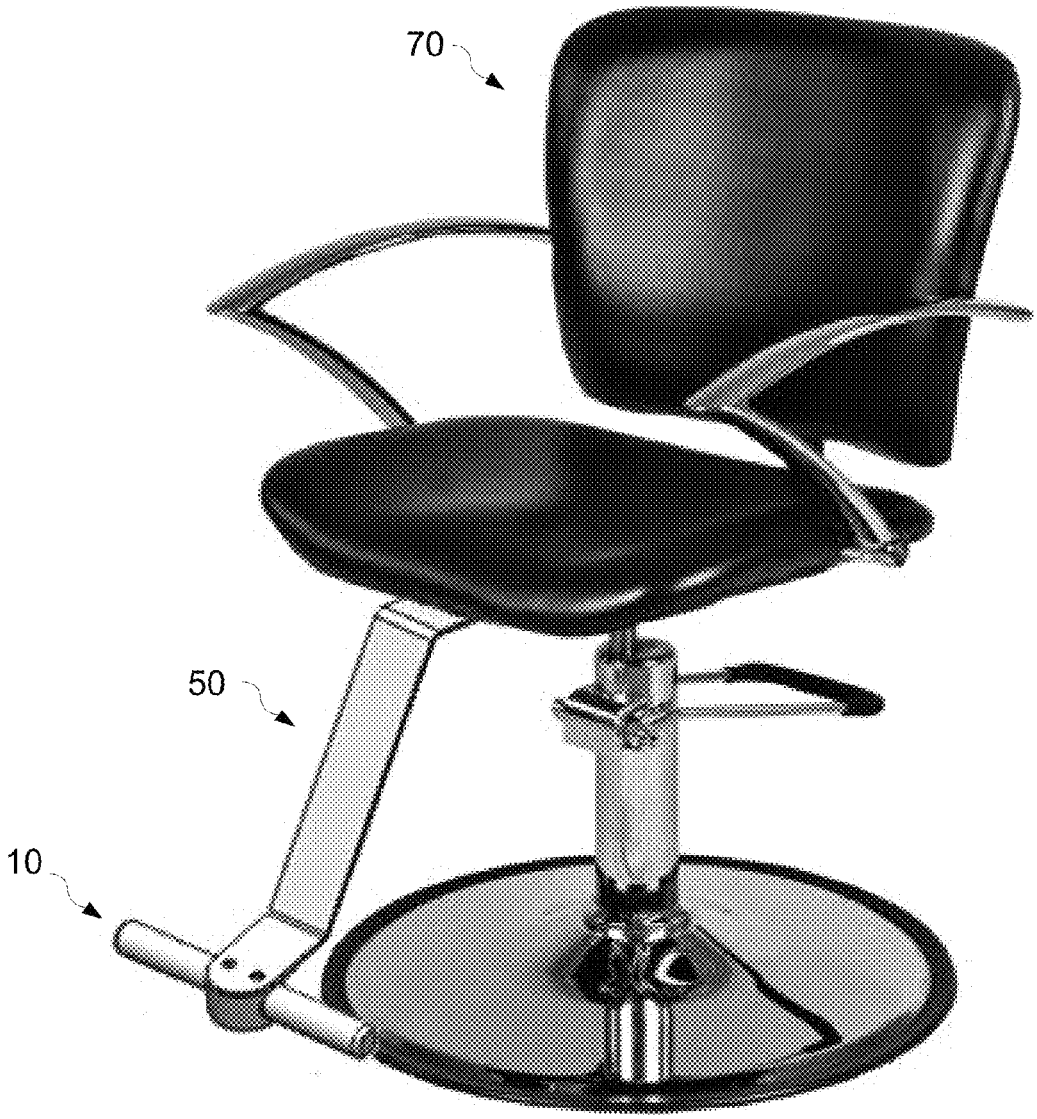
FIG. 2 is a perspective view of a stylist chair according to a first embodiment.
Figure 3:
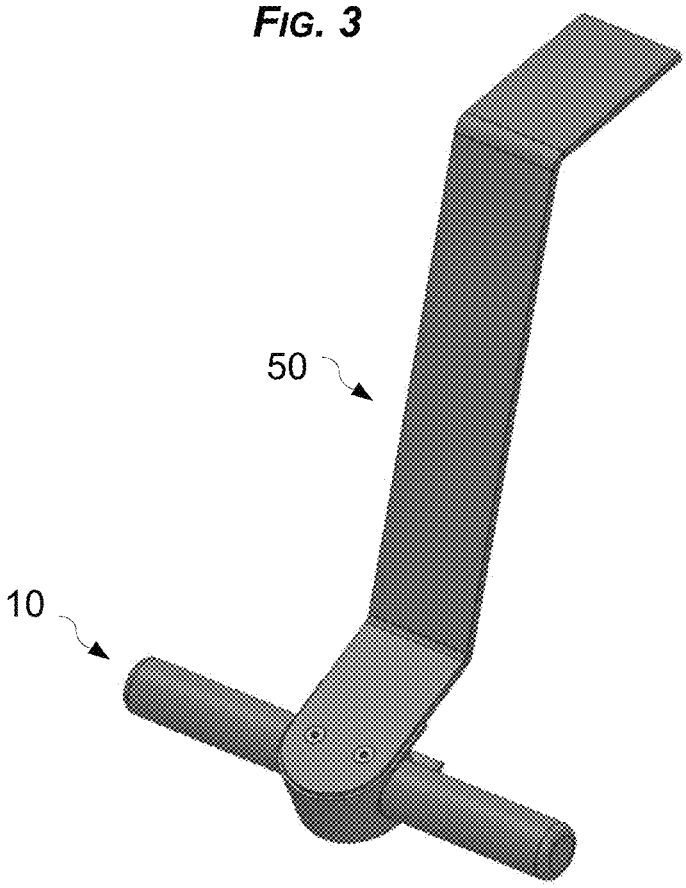
FIG. 3 is a perspective view of a center bar and footrest assembly according to the first embodiment, wherein the footrest assembly is in an open configuration.
Figure 4:
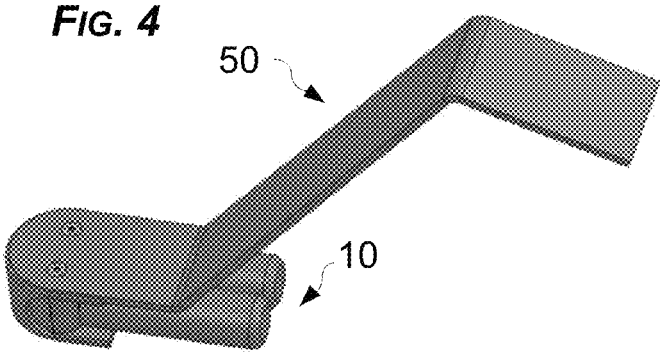
FIG. 4 is a perspective view of a center bar and footrest assembly according to the first embodiment, wherein the footrest assembly is in a closed configuration.

FIGS. 2-10 illustrate a footrest assembly 10 according to the first embodiment. The footrest assembly 10 can be coupled to a stylist chair 70 through a central bar 50, as shown in FIG. 2. Each the stylist chair 70 and central bar 50 can have any design or configuration known in the art. Likewise, the footrest assembly 10 can be attached to the central bar 50 using attachment mechanisms known in the art. The footrest assembly 10 has an open configuration and a closed configuration. In the open configuration, as shown in FIG. 3, the footrest assembly 10 forms a footrest that enables a user to rest his or her feet on when using the stylist chair 70. In the closed configuration, as shown in FIG. 4, the footrest assembly 10 closes enables a user to easily exit the stylist chair 70.

The footrest assembly 10 includes a first pedal 12*a*, a second pedal 12*b* and a gear assembly 14. The first pedal 12*a* and the second pedal 12*b* are each coupled to the gear assembly 14. The gear assembly 14 is a cooperating gear assembly that causes the first pedal 12*a* and the second pedal 12*b* to move simultaneously together and cooperate with one another. In other words, when one of the first pedal 12*a* or the second pedal 12*b* moves, the other of the first pedal 12*a* or the second pedal 12*b* simultaneously moves. In the first embodiment, the gear assembly 14 includes a first gear 14*a* and a second gear 14*b*. The first gear 14*a* is coupled to the first pedal 12*a*. Likewise, the second gear 14*b* is coupled to the second pedal 12*b*. The pedals 12*a*, 12*b* generally move forward and backward.

Figure 5:
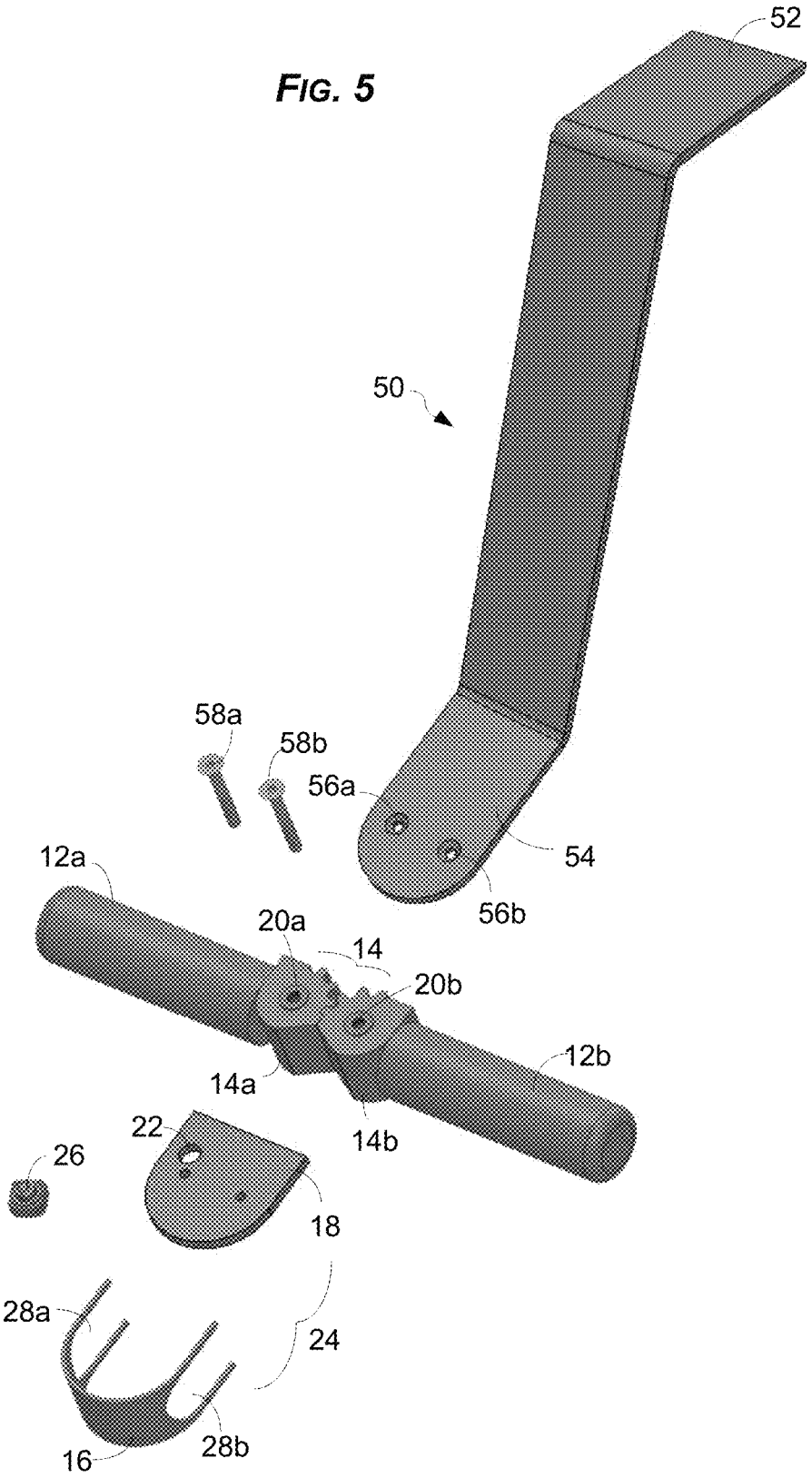
FIG. 5 is an exploded view of a center bar and footrest assembly according to the first embodiment.
Figure 6:
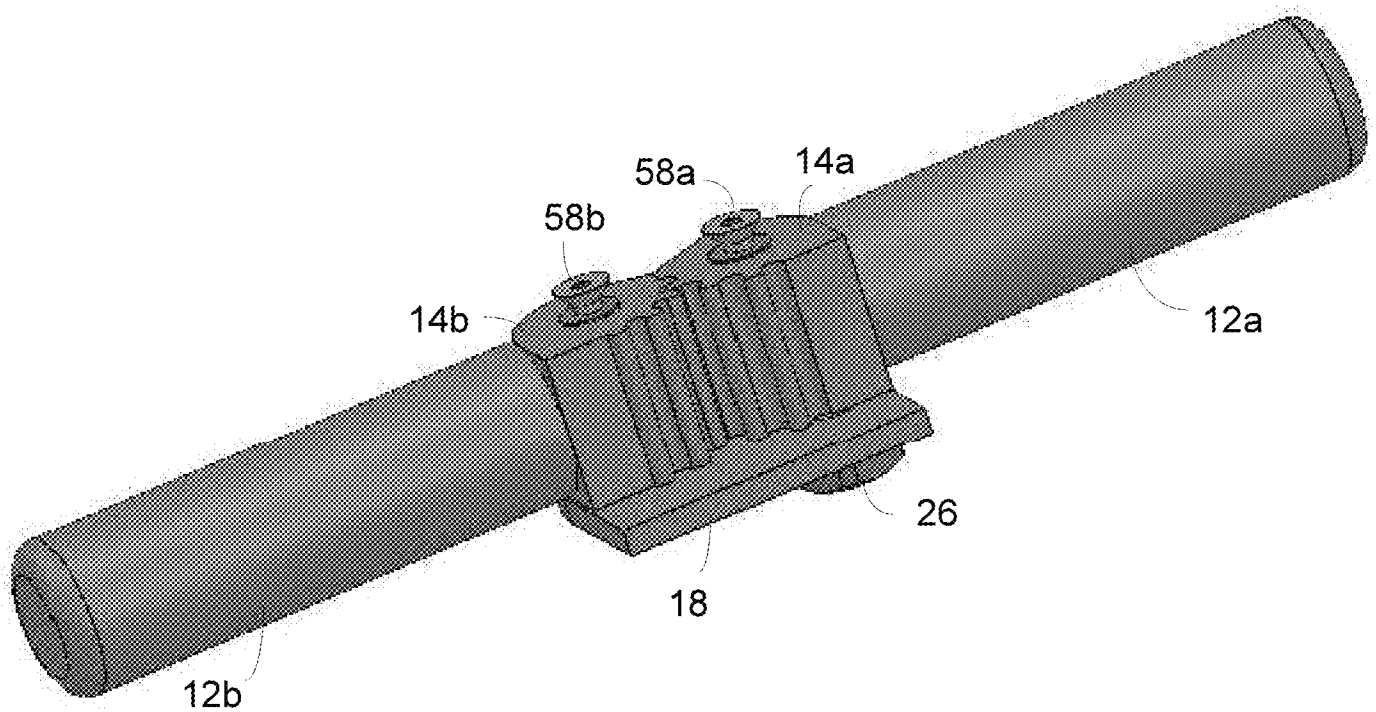
FIG. 6 is a perspective view of a first pedal, second pedal and gear assembly according to the first embodiment, wherein a bottom plate is secured to the gear assembly.

The footrest assembly 10 also includes an optional housing 24 that covers at least a portion of the gear assembly 14. The housing 24 can have a variety of different configurations. As shown in FIG. 5, the housing 24 includes a front guard 16 and a bottom plate 18. The front guard 16 has a shape (such as a horseshoe shape) that generally matches the shape of the bottom plate 18, so the front guard 16 can rest on top of or around the periphery of bottom plate 18. The bottom plate 18 also includes a hole 22. Each the first gear 14*a* and the second gear 14*b* is positioned on top of the bottom plate 18. A fastening device 26 (such as a screw) extends through the hole 22 and into a corresponding hole (not shown) on the bottom of the first gear 14*a*. Thus, as shown in FIG. 6, the fastening device 26 secures the bottom plate 18 to the first gear 14*a*. Referring back to FIG. 5, the front guard 16 also has two openings 28*a*, 28*b* through which the first pedal 12*a* and the second pedal 12*b* can extend through. The front guard 16 is positioned around the gear assembly 14 so that the first pedal 12*a* extends through the opening 18*a* and the second pedal 12*b* extends through the opening 26*b*.

Figure 7:
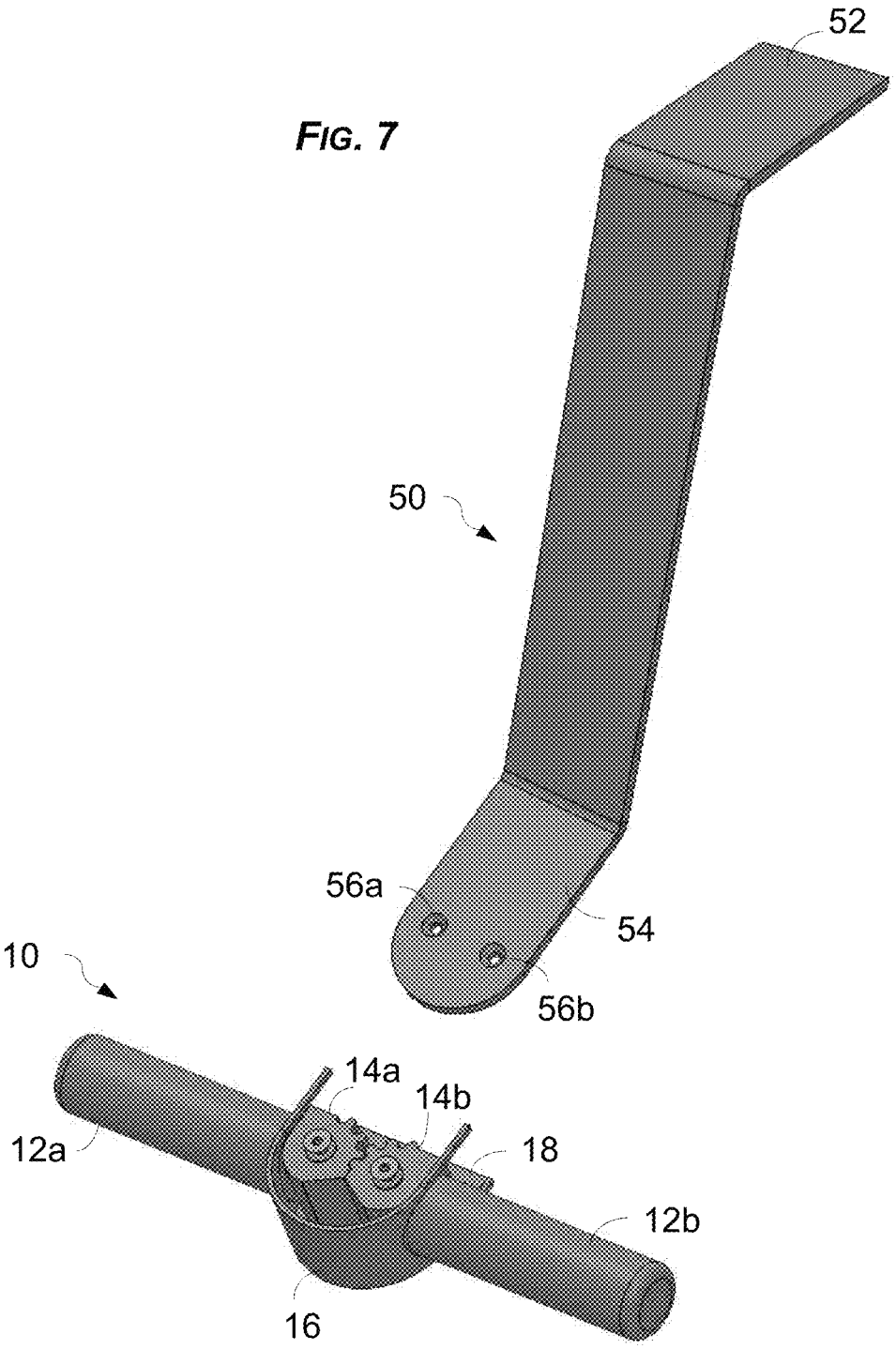
FIG. 7 is a perspective view of a center bar and footrest assembly according to the first embodiment, wherein the center bar is detached from the gear assembly.

The central bar 50 is also secured to the footrest assembly 10. Referring to FIG. 7, the central bar 50 can be secured to the first gear 14*a* and the second gear 14*b*. For example, the first gear 14*a* has a top hole 20*a* and the second gear 14*b* has a top hole 20*b*. The central bar 50 also has holes 56*a*, 56*b*. The hole 56*a* is configured to align with hole 20*a* and the hole 56*b* is configured to align with hole 20*b*. A pair of screws 58*a*, 58*b* extend through holes 56*a*, 56*b* into holes 20*a*, 20*b* to secure the central bar 50 to the first gear 14*a* and the second gear 14*b*. Once the central bar 50 is secured to the first gear 14*a* and the second gear 14*b*, the central bar 50, together with the housing 24, hides at least a portion of the gear assembly 14.

Figure 8:
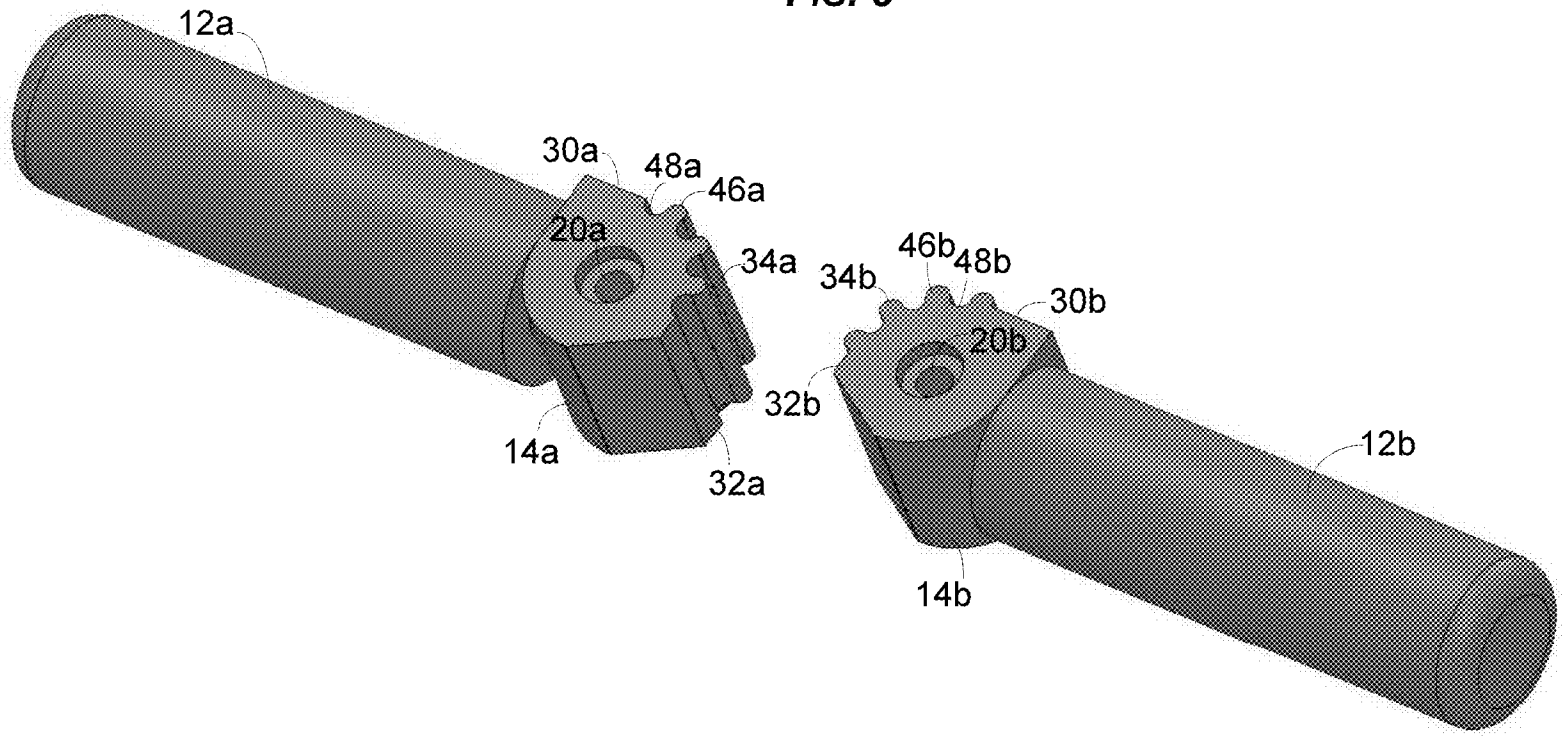
FIG. 8 is a perspective view of a first pedal, second pedal and gear assembly according to the first embodiment, wherein the first gear and the second gear of the gear assembly are separated.

The first gear 14*a* and the second gear 14*b* are coupled to one another in a cooperating fashion, so that when one gear moves, the other gear simultaneously moves. As best shown in FIG. 8, the first gear 14*a* includes a plurality of teeth 34*a* and the second gear 14*b* also includes a plurality of teeth 34*b*. The plurality of teeth 34*a* of the first gear 14*a* engages with the plurality of teeth 34*b* of the second gear 14*b* to cause the first gear 14*a* and the second gear 14*b* to cooperate with one another. The plurality of teeth 34*a*, 34*b* can have any desired configuration that allows the first gear 14*a* and the second gear 14*b* to engage with and cooperate with one another. In this first embodiment, the plurality of teeth 34*a* includes three peaks 46*a* and four grooves 48*a* adjacent the peaks 46*a* and the plurality of teeth 34*b* includes four peaks 46*b* and three grooves 48*b* adjacent the peaks 46*b*. The three peaks 46*a* of the first plurality of teeth 34 mate with the three grooves 48*b* of the second plurality of teeth 34*b*. Likewise, the four peaks 46*b* of the second plurality of teeth 34*b* mate with the four grooves 48*a* of the first plurality of teeth 34*a*. Of course, any number of peak and groove combinations can be present on the plurality of teeth 34*a*, 34*b* to enable the first gear 14*a* and the second gear 14*b* to engage with one another.

The pedals 12*a*, 12*b* cooperate with one another through the gears 14*a*, 14*b*. Specifically, the first gear plurality of teeth 34*a* engages with the second gear plurality of teeth 34*b* so that as one of the first gear 14*a* or the second gear 14*b* is turned, the engaging plurality of teeth 34*a*, 34*b* causes the other of the first gear 14*a* or the second gear 14*b* to simultaneously turn. Specifically, when a user moves the first pedal 12*a* rearward (towards the stylist chair), the first gear 14*a* turns clockwise. The engaging plurality of teeth 34*a*, 34*b* causes the second gear 14*b* to turn counterclockwise simultaneously, also causing the second pedal 12*b* to move rearward simultaneously. Likewise, when a user moves the first pedal 12*a* forward (away from the stylist chair), the first gear 14*a* turns counterclockwise. The engaging plurality of teeth 34*a*, 34*b* causes the second gear 14*b* to turn clockwise simultaneously, also causing the second gear 14*b* to move forward simultaneously.

In other words, when a user moves the second pedal 12*b* rearward, the second gear 114*b* turns counterclockwise. The engaging plurality of teeth 34*a*, 34*b* causes the first gear 14*a* to turn clockwise simultaneously, also causing the first pedal 12*a* to move rearward simultaneously. Likewise, when a user moves the second pedal 12*b* forward, the second gear 114*b* turns clockwise. The engaging plurality of teeth 34*a*, 34*b* causes the first gear 114*a* to turn counterclockwise simultaneously, also causing the first gear 14*a* to move forward simultaneously. Thus, the first pedal 12*a* and the second pedal 12*b* always move rearward and forward together and simultaneously.

Figure 9:
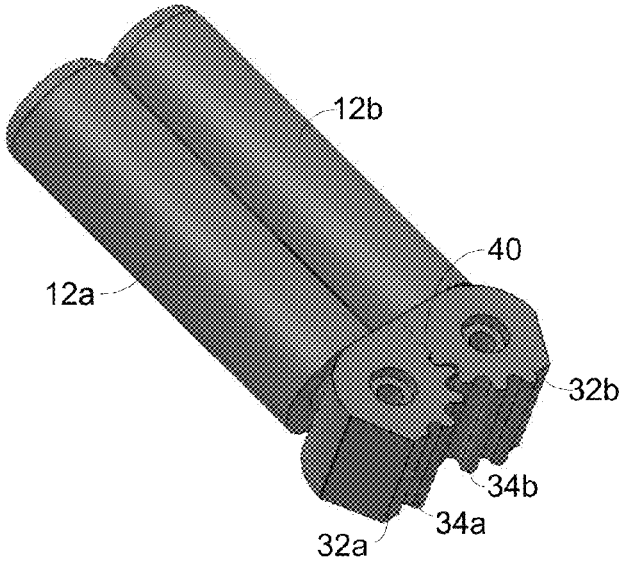
FIG. 9 is a perspective view of a first pedal, second pedal and gear assembly in a closed configuration according to the first embodiment.
Figure 10:
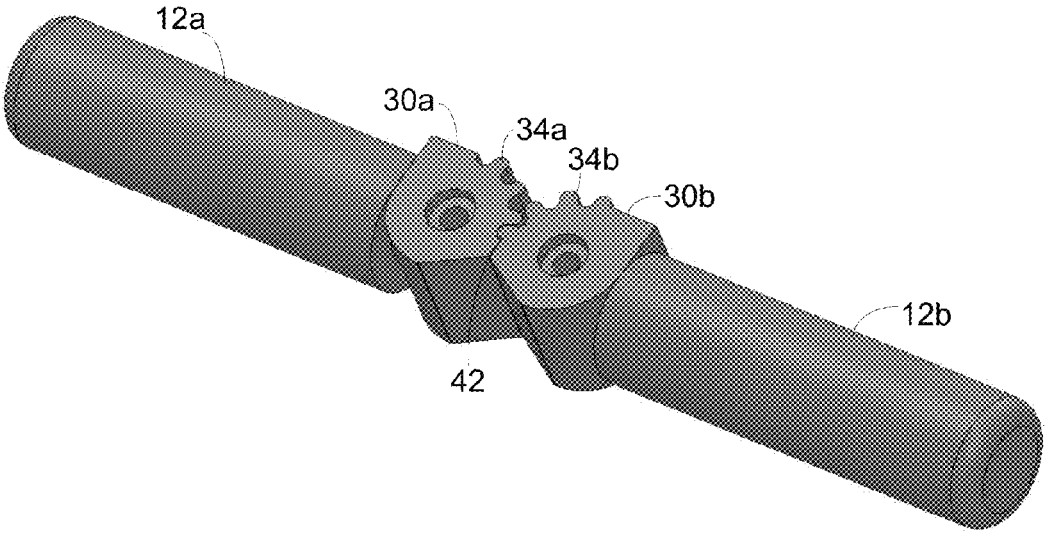
FIG. 10 is a perspective view of a first pedal, second pedal and gear assembly in an open configuration according to the first embodiment.
Figure 11:
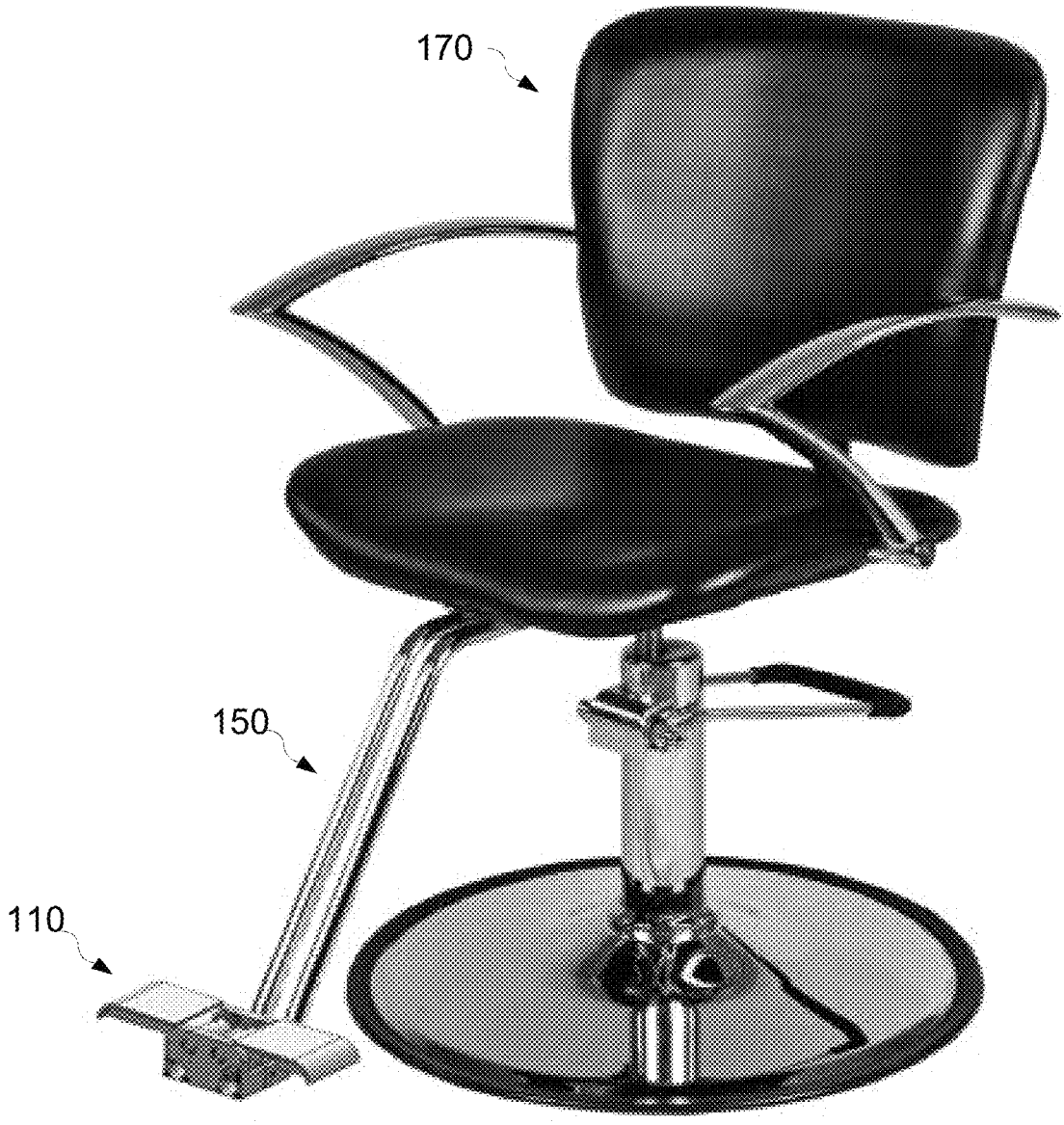
FIG. 11 is a perspective view of a stylist chair according to a second embodiment.

Additionally, the gears 14*a*, 14*b* include stops that hold them in place in either the open configuration or the closed configuration. These stops are perhaps best illustrated in FIGS. 9 and 10. FIG. 9 shows the gears 14*a*, 14*b* (and thus the pedals 12*a*, 12*b*) in a closed configuration and FIG. 10 shows the gears 14*a*, 14*b* (and thus the pedals 12*a*, 12*b*) in an open configuration. The first gear 14*a* includes a proximal edge 30*a* and a distal edge 32*a*. Likewise, the second gear 14*b* includes a proximal edge 30*b* and a distal edge 32*b*.

As best shown in FIG. 9, the proximal edge 30*a* of the first gear 14*a* abuts the proximal edge 30*b* of the second gear 14*b* to position the first pedal 12*a* and the second pedal 12*b* in the closed configuration. When the proximal edges 30*a*, 30*b* abut together, they form a proximal junction 40 or stop. In this closed configuration, the first pedal 12*a* and the second pedal 12*b* are moved forward and toward one another so that they are adjacent to or even in contact with one another. This closed configuration enables a user to easily exit the stylist chair.

As best shown in FIG. 10, the distal edge 32*a* of the first gear 14*a* abuts the distal edge 32*b* of the second gear 14*b* to position the first pedal 12*a* and the second pedal 12*b* in the open configuration. When the distal edges 32*a*, 32*b* abut together, they form a distal junction 42 or stop. In this open configuration, the first pedal 12*a* and the second pedal 12*b* are moved rearward and away from one another so that they extend outward as a footrest. This open configuration provides a footrest that enables a user to rest his or her feet on when using the stylist chair.

During use, a user simply moves the pedals 12*a*, 12*b* rearward and forward between the open configuration and the closed configuration. As shown in FIG. 9, when a user moves the either the first pedal 12*a* or the second pedal 12*b* rearward towards the closed configuration, the interlocking plurality of teeth 34*a*, 34*b* allow for the gears 14*a*, 14*b* to turn until their proximal edges 30*a*, 30*b* abut one another at the proximal junction 40. The proximal junction 40 therefore serves as a stop that holds the pedals 12*a*, 12*b* in the closed configuration. Likewise, as shown in FIG. 10, when a user moves the either the first pedal 12*a* or the second pedal 12*b* forward towards the open configuration, the interlocking plurality of teeth 34*a*, 34*b* allow for the gears 14*a*, 14*b* to turn until their distal edges 32*a*, 32*b* abut one another at the distal junction 42. The distal junction 42 therefore serves as a stop that holds the pedals 12*a*, 12*b* in the open configuration.

FIGS. 11-26 illustrate a footrest assembly 110 according to a second embodiment. FIG. 2 shows a stylist chair 170 having a footrest assembly 110. The footrest assembly 110 is coupled to the stylist chair 170 via the central bar 150. Each the stylist chair 170 and central bar 150 can have any design or configuration known in the art. Likewise, the footrest assembly 110 can be attached to the central bar 150 using attachment mechanisms known in the art.

Figure 12:
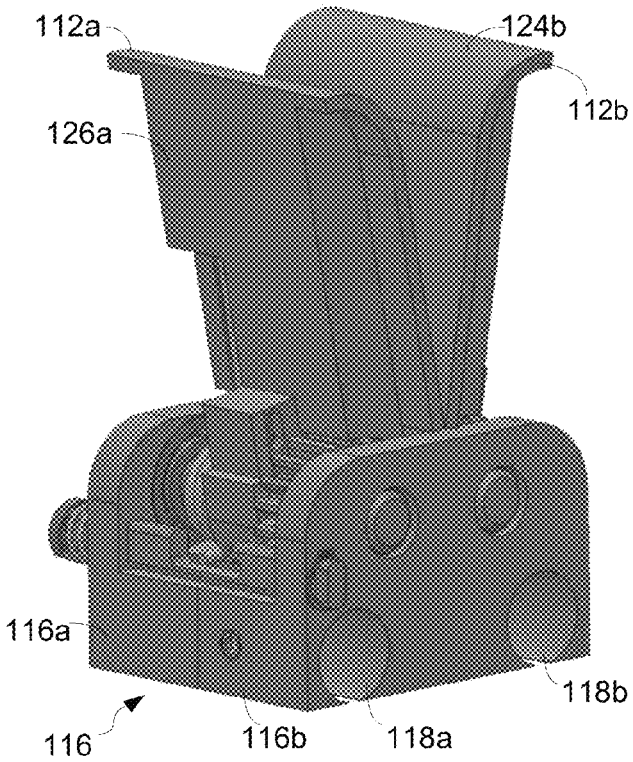
FIG. 12 is a perspective view of a footrest assembly according to the second embodiment, wherein the footrest assembly is in a closed configuration.
Figure 13:
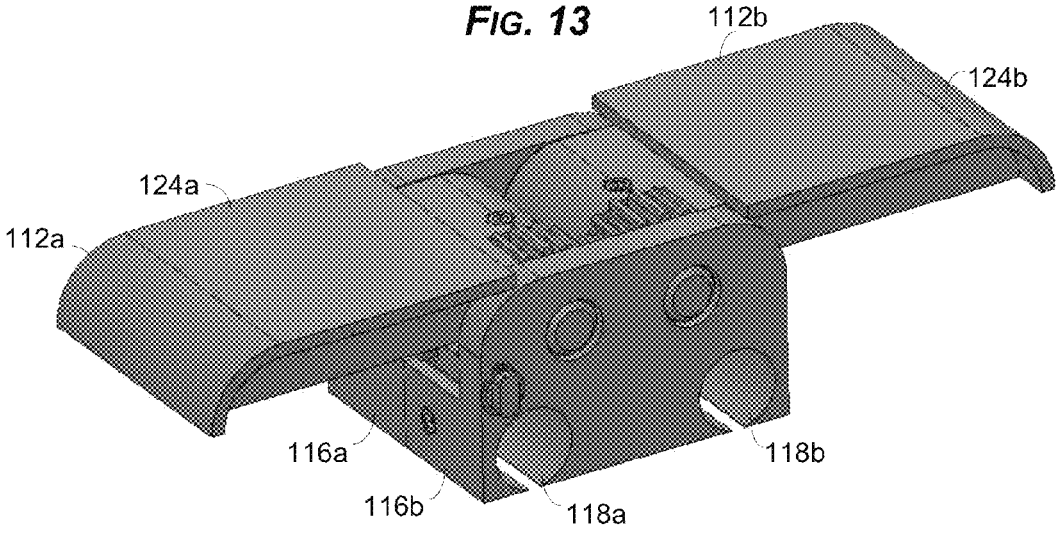
FIG. 13 is a perspective view of a footrest assembly according to the second embodiment, wherein the footrest assembly is in an open configuration.
Figure 14:
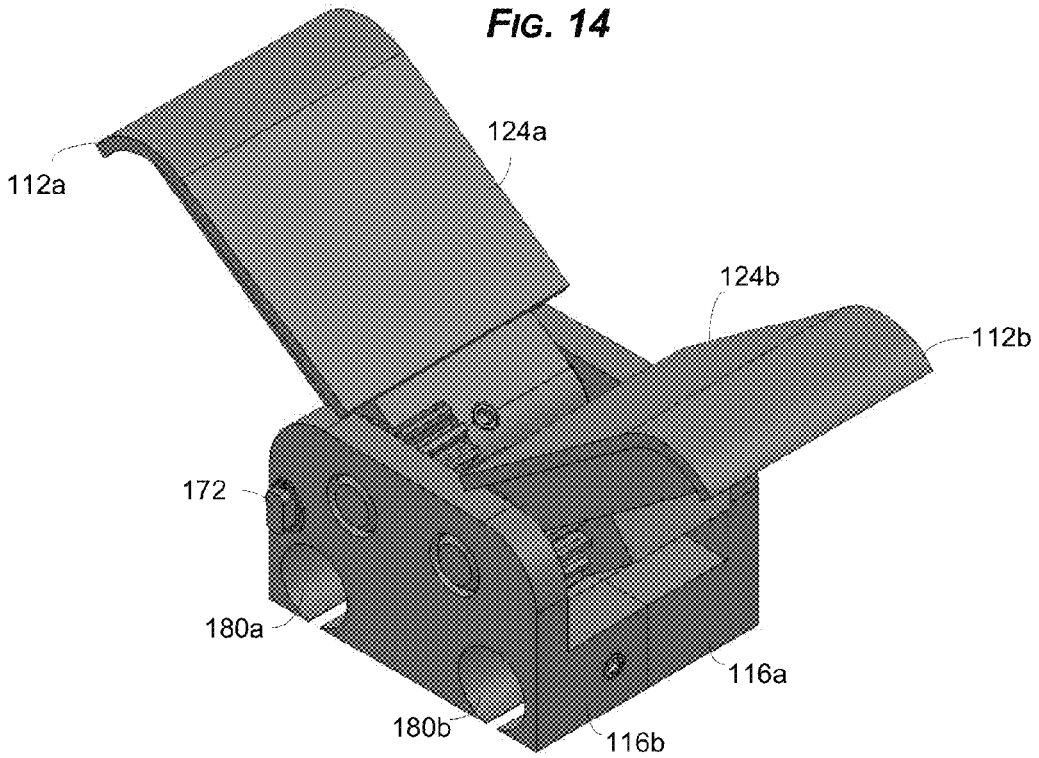
FIG. 14 is a perspective view of a footrest assembly according to the second embodiment, wherein the footrest assembly is in between a closed configuration and an open configuration.
Figure 15:
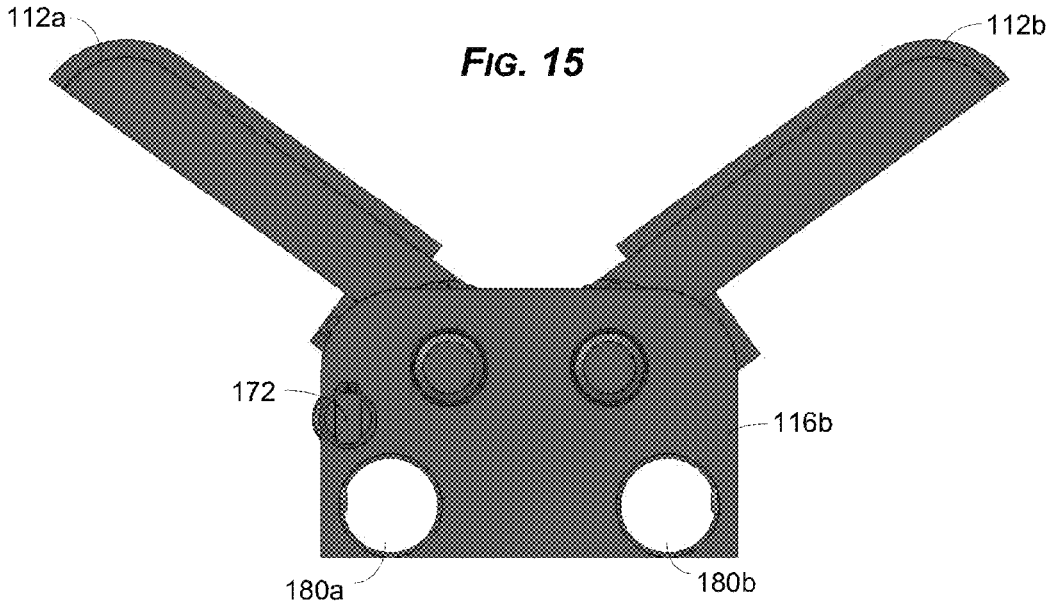
FIG. 15 is a back side view of a footrest assembly according to the second embodiment, wherein the footrest assembly is in between a closed configuration and an open configuration.

Like the footrest assembly 10 of the first embodiment, the footrest assembly 110 of the second embodiment is also movable between an open configuration and a closed configuration. FIG. 12 shows the footrest assembly 110 in a closed configuration. In the closed configuration, the footrest assembly 110 closes and enables a user to easily exit the stylist chair 170. FIG. 13 shows the footrest assembly 110 in an open configuration. In the open configuration, the footrest assembly 110 forms a footrest that enables a user to rest his or her feet on when using the stylist chair 170. FIGS. 14 and 15 show the footrest assembly 110 in a configuration that is in between the closed configuration shown in FIG. 12 and the open configuration shown in FIG. 13.

Generally, the footrest assembly 110 includes a gear assembly 114, a first pedal 112*a* and a second pedal 112*b*. Like the first embodiment, the first pedal 112*a* and the second pedal 112*b* are coupled to the gear assembly 114 and the gear assembly 114 is a cooperating gear assembly that causes the first pedal 112*a* and the second pedal 112*b* to move simultaneously together. The gear assembly 114 also includes a first gear 114*a* and a second gear 114. The first gear 114*a* is coupled to the first pedal 112*a* and the second gear 114*b* is coupled to the second pedal 112*b*. The pedals 112*a*, 112*b* generally move upward and downward between the closed configuration shown in FIG. 12 and the open configuration shown in FIG. 13.

Referring to FIGS. 12 through 15, the footrest assembly 110 also includes an optional housing 116 that surrounds at least a portion of the gear assembly 114. The housing 116 can have a variety of different configurations. In the second embodiment, the housing 116 is a two-piece structure and includes a first section 116*a* and a second section 116*b*. The sections 116*a*, 116*b* are assembled together to form the housing 116 that surrounds at least a portion of the gear assembly 114. Of course, the housing 116 can alternatively include a three-piece structure, four-piece structure and the like. The housing 116 can include openings 180*a*, 180*b*, which receive tubular portions of the central bar 150. Of course, other attachment mechanisms to the central bar 150 can be used instead.

Figure 16:
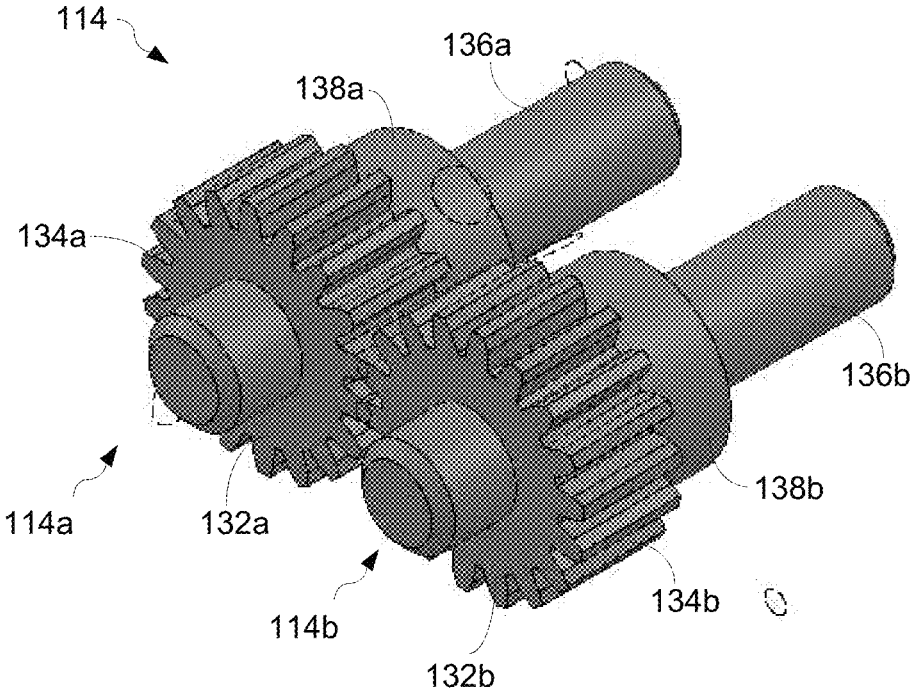
FIG. 16 is a perspective view of a gear assembly according to the second embodiment.
Figure 17:
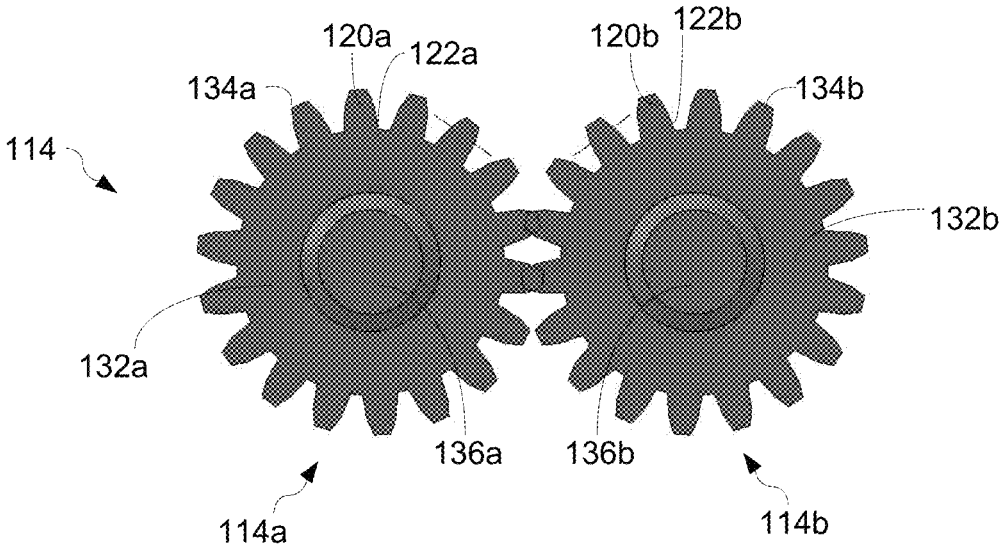
FIG. 17 is a back side view of a gear assembly according to the second embodiment.

As shown in FIGS. 16 and 17, the gear assembly 114 includes a first gear 114*a* and a second gear 114*b*. Each the first gear 114*a* and the second gear 114*b* includes a generally circular body 132*a*, 132*b* having an outer perimeter or circumference 134*a*, 134*b*. In some embodiments, the first gear 114*a* and the second gear 114*b* are mirror images of one another, although this is by no means required. At least a portion of the outer circumference 134*a*, 134*b* defines a plurality of teeth. In the illustrated embodiment, the entire outer circumference 134*a*, 134*b* defines the plurality of teeth.

The plurality of teeth 134*a*, 134*b* can have any desired configuration that allows the first gear 14*a* and the second gear 14*b* to engage with and cooperate with one another. The plurality of teeth 134*a*, 134*b* generally includes alternating peaks 146*a*, 146*b* and grooves 148*a*, 148*b*. Each peak 146*a* peak on the first gear 114*a* has a size and shape that fits or mates within each groove 148*b* on the second gear 114*b*. Likewise, each peak 146*b* peak on the second gear 114*b* has a size and shape that fits or mates within each groove 148*a* on the first gear 114*a*. In the second embodiment, all of the peaks 146*a*, 146*b* are identical and all of the grooves 148*a*, 148*b* are identical, but this is by no means required. Any desired peak and groove configuration can be used to cause the plurality of teeth 134*a*, 134*b* to engage with each other.

The generally circular body 132*a*, 132*b* of each gear 114*a*, 114*b* also has an extending portion 138*a*, 138*b* that extends outward from the body 132*a*, 132*b*. The extending portion 138*a*, 138*b* also has a generally circular shape. In some embodiments, the extending portion 138*a*, 138*b* has the same size and shape of the generally circular body 132*a*, 132*b* but does not include the outer plurality of teeth 134*a*, 134*b*. Both the generally circular body 132*a*, 132*b* and the extending portion 138*a*, 138*b* include a central bore (not shown) that extends all the way through from a front of the circular body 132*a*, 132*b* to a rear of the extending portion 138*a*, 138*b*.

An axle 136*a*, 136*b* extends through the central bore. The axle 136*a*, 136*b* has a generally circular body that is sized and shaped to extend through the central bore. More specifically, the axle 136*a*, 136*b* has a front end and a rear end, the front end being the portion that extends outward and frontward from the generally circular body 132*a*, 132*b* and the rear end being the portion that extends outward and rearward from the extending portion 136*a*, 136*b*.

Figure 18:
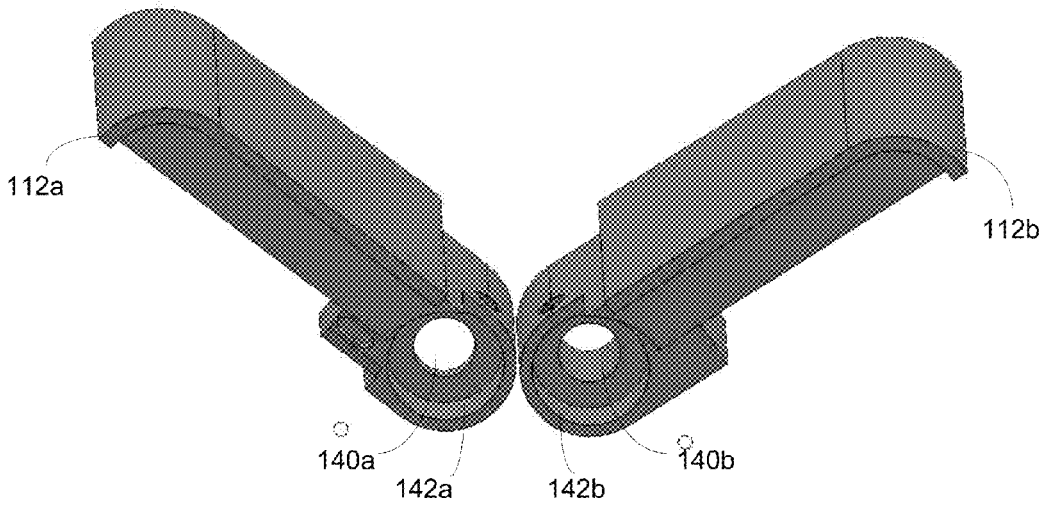
FIG. 18 is a perspective view of a first pedal and a second pedal of a footrest assembly according to the second embodiment.
Figure 19:
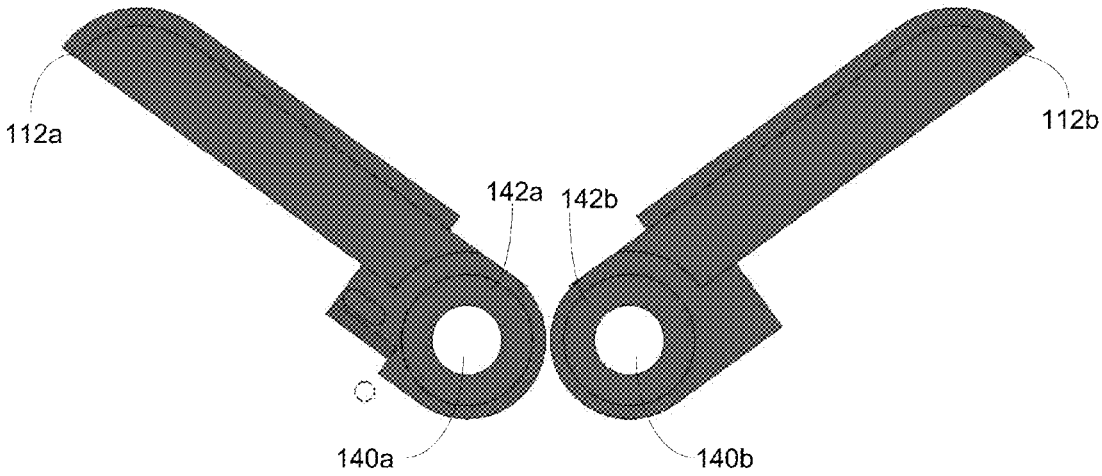
FIG. 19 is a back side view of a first pedal and a second pedal of a footrest assembly according to the second embodiment.

The first gear 114*a* is coupled to the first pedal 112*a* and the second gear 114*b* is coupled to the second pedal 112*b*. Referring to FIGS. 18 and 19, the pedal 112*a*, 112*b* includes a receiving hole 140*a*, 140*b* and a recess 142*a*, 142*b*. The receiving hole 140*a*, 140*b* extends through the recess 142*a*, 142*b*. In the second embodiment, the recess 142*a*, 142*b* is generally circular in shape and the receiving hole 140*a*, 140*b* has a shape that is smaller than the shape of the recess 142*a*, 142*b*.

The axle 136*a*, 136*b* extends through the receiving hole 140*a*, 140*b* to secure the gear 114*a*, 114*b* to the pedal 112*a*, 112*b*. Generally, the gear 114*a*, 114*b* is inserted into the retaining hole 140*a*, 140*b* so that the rear end of the axle 136*a*, 136*b* extends through the retaining hole 140*a*, 140*b*. At the same time, the extending portion 138*a*, 138 fits nicely within the recesses 142*a*, 142*b*. As such, the recess 142*a*, 142*b* has a size and shape that matches the size and shape of the extending portion 136*a*, 136*b* so that the extending portion 136*a*, 136*b* can fit within the recessed portion 142*a*, 142*b*. This allows the pedals 112*a*, 112*b* to be coupled to the gears 114*a*, 114*b*.

The pedals 112*a*, 112*b* cooperate with one another through the gears 114*a*, 114*b*. Specifically, the first gear plurality of teeth 134*a* engages with the second gear plurality of teeth 134*b* so that as one of the first gear 114*a* or the second gear 114*b* is turned, the engaging plurality of teeth 134*a*, 134*b* causes the other of the first gear 114*a* or the second gear 141*b* to simultaneously turn. Specifically, referring to FIGS. 20 through 22, when a user moves the first pedal 112*a* downward, the first gear 114*a* turns clockwise. The engaging plurality of teeth 134*a*, 134*b* causes the second gear 114*b* to turn counterclockwise simultaneously, also causing the second pedal 112*b* to move downward simultaneously. Likewise, when a user moves the first pedal 112*a* upward, the first gear 114*a* turns counterclockwise. The engaging plurality of teeth 134*a*, 134*b* causes the second gear 114*b* to turn clockwise simultaneously, also causing the second gear 114*b* to move upward simultaneously.

In other words, when a user moves the second pedal 112*b* downward, the second gear 114*b* turns counterclockwise. The engaging plurality of teeth 134*a*, 134*b* causes the first gear 114*a* to turn clockwise simultaneously, also causing the first pedal 112*a* to move downward simultaneously. Likewise, when a user moves the second pedal 112*b* upward, the second gear 114*b* turns clockwise. The engaging plurality of teeth 134*a*, 134*b* causes the first gear 114*a* to turn counterclockwise simultaneously, also causing the first gear 114*a* to move upward simultaneously. Thus, the first pedal 112*a* and the second pedal 112*b* always move upward and downward together and simultaneously.

Figure 22:
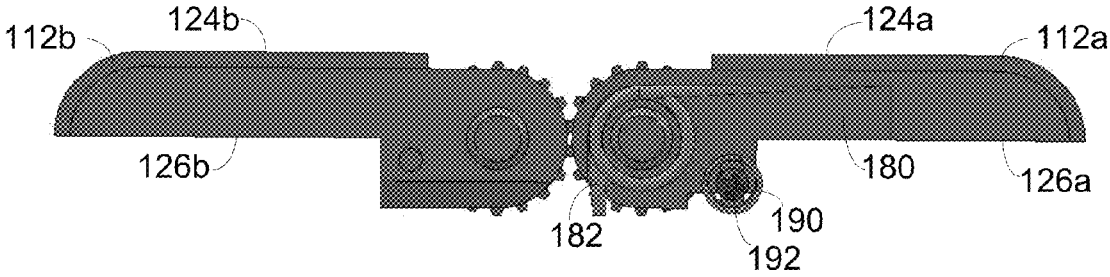
FIG. 22 is a front side view of a footrest assembly without a housing according to the second embodiment, wherein the footrest assembly is in an open configuration.

With continued reference to FIGS. 20 through 22, the footrest assembly 110 also includes a biasing apparatus 182 that biases the footrest assembly 110 towards the closed configuration. The pedals 112*a*, 112*b* include top surfaces 124*a*, 124*b* and bottom surfaces 126*a*, 126*b*. The top surfaces 124*a*, 124*b* define a footrest surface. The bottom surface 126*a* of the first pedal 112*a* includes a recess 180 that houses the biasing apparatus 182. The recess 180 and the biasing apparatus 182 can have any desired shape or configuration that allows the biasing apparatus 182 to fit within and be retained by the recess 180. The biasing apparatus 182 can be a torsion spring that biases the first pedal 112*a* (and thus the second pedal 112*b*) upwards and towards the closed configuration shown in FIG. 20. In order to move the pedals 112*a*, 112*b* towards the open configuration shown in FIG. 22, a user must apply a generally downward force to one of the pedals 112*a*, 112*b*. This force goes against the biasing force of the biasing apparatus 182 to force the pedals 112*a*, 112*b* downward and towards the open configuration.

Figure 23:
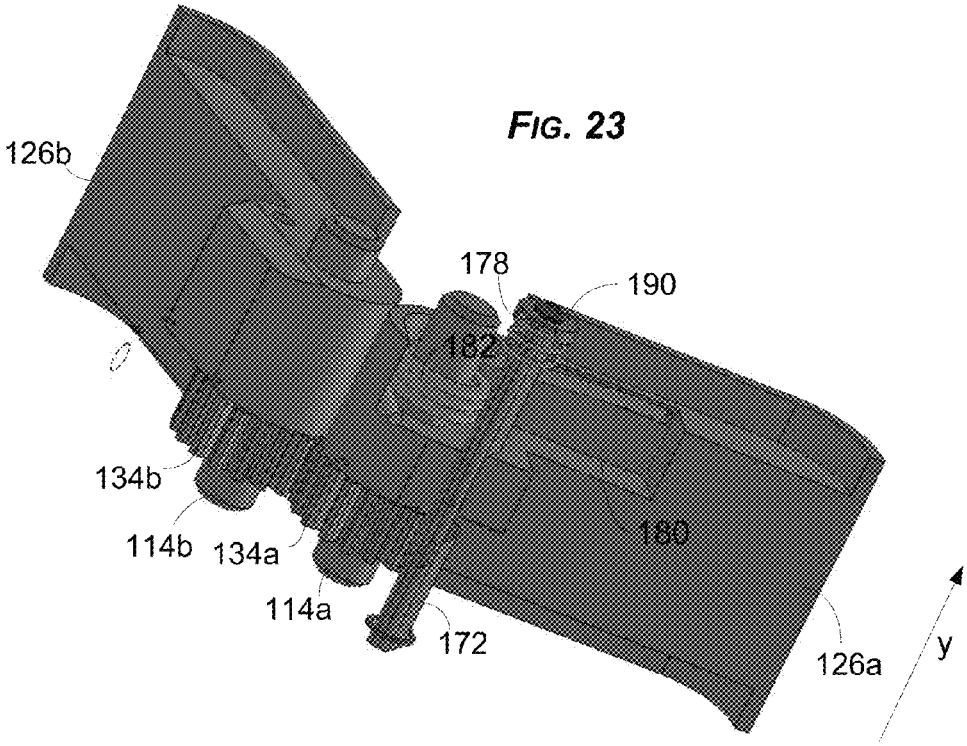
FIG. 23 is a bottom perspective view of a footrest assembly without a housing according to the second embodiment, wherein the footrest assembly is in between a closed configuration and an open configuration.
Figure 24:
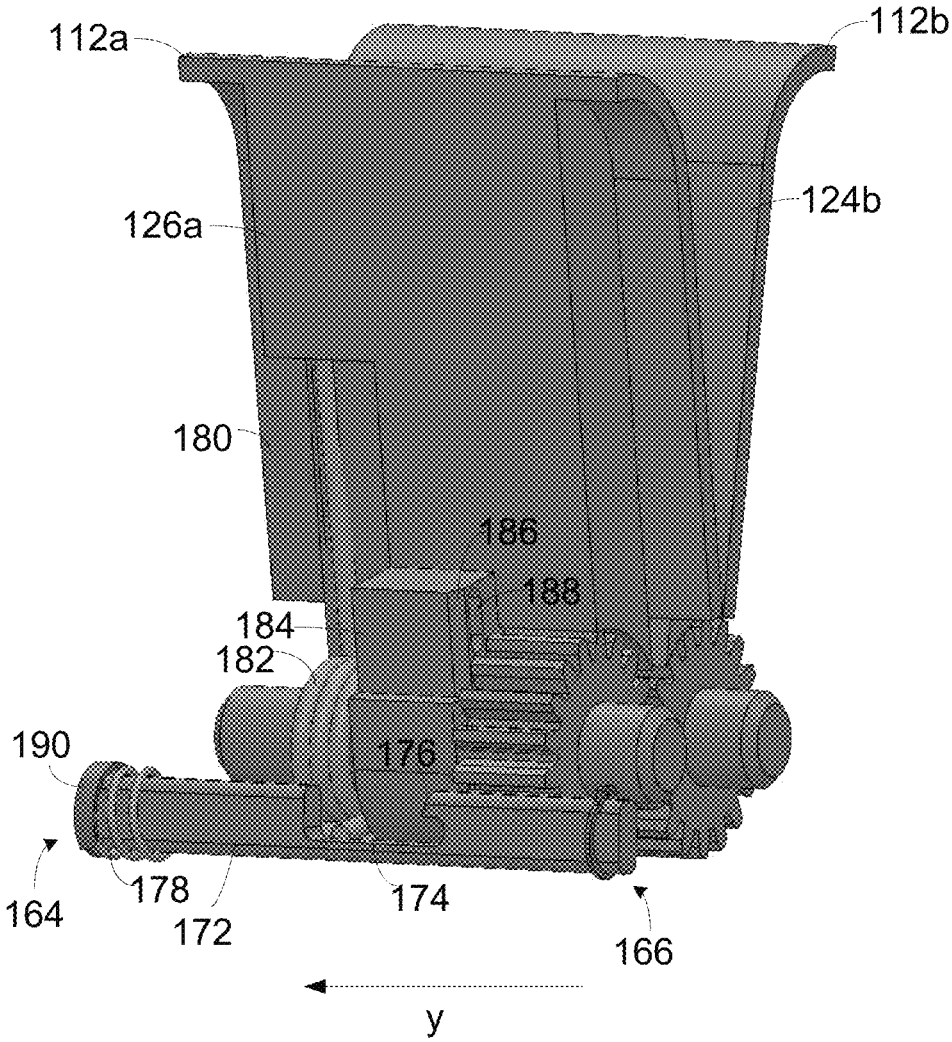
FIG. 24 is a side perspective view of a footrest assembly without a housing according to the second embodiment, wherein the footrest assembly is in a closed configuration.

The footrest assembly 110 also includes a locking mechanism. Referring to FIGS. 23 and 24, the locking mechanism includes a lever 172 that locks and unlocks the pedals 112*a*, 112*b* in the open configuration. The lever 172 is coupled to the bottom surface 126*a* of the first pedal 112*a*. The lever 172 includes a front end 164 and a rear end 166. The frontend 164 includes a knob 190 for gripping by a user. The lever also includes a biasing apparatus 178 that biases the lever in a forward direction y. The biasing apparatus 178 can be a compression spring that pushes the lever forwardly in the direction y. The compression spring can have a size and shape that allows it to be positioned on the lever 172 so that it wraps around at least a portion of the front end 164. The knob 190 is also placed on the front end 164 so that it holds the compression spring in place on the front end 164. In some cases, the compression spring is secured to the knob 190 itself.

Figure 25:
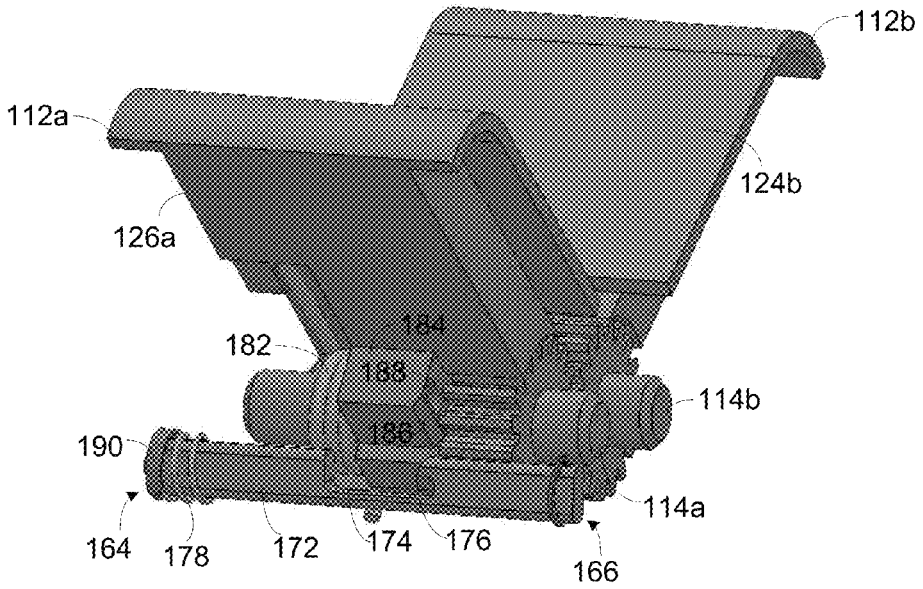
FIG. 25 is a side perspective view of a footrest assembly without a housing according to the second embodiment, wherein the footrest assembly is in between a closed configuration and an open configuration.
Figure 26:
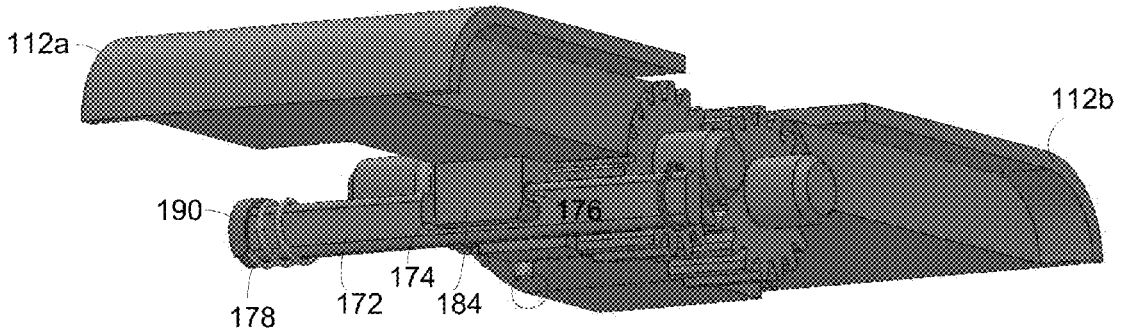
FIG. 26 is a side perspective view of a footrest assembly without a housing according to the second embodiment, wherein the footrest assembly is in an open configuration.

Referring to FIG. 25, the lever 172 also includes a bellow 174 that is positioned on the lever 172 so that it is in between the front end 164 and the rear end 166. The lever bellow 174 includes an engaging surface or shoulder 176. The bottom surface 126*a* of the first pedal 112*a* also includes a protrusion 184 that extends outward and downward from the bottom surface 126*a*. The protrusion 184 also includes an engaging surface or shoulder 186. The bellow engaging surface 176 is configured to slidably engage with the protrusion engaging surface 186. The surfaces 176, 186 can have any desired configuration that allows them to slidably engage with one another. In this second embodiment, the surfaces 176, 186 are slanted at angles that allow the surfaces 176, 186 to slide over one another. Typically, both surfaces 176, 186 will be slanted at the same angle. The protrusion 184 of the bottom surface 126*a* of the first pedal 112*a* also includes a receiving aperture 188 that is positioned above the engaging surface 186 and receives the bellow engaging surface 176. As such, the aperture 188 has a size and shape that allows for the bellow engaging surface 176 to insert thereinto. FIG. 26 best shows the receiving aperture 188 receiving the bellow engaging surface 176.

Figure 27:
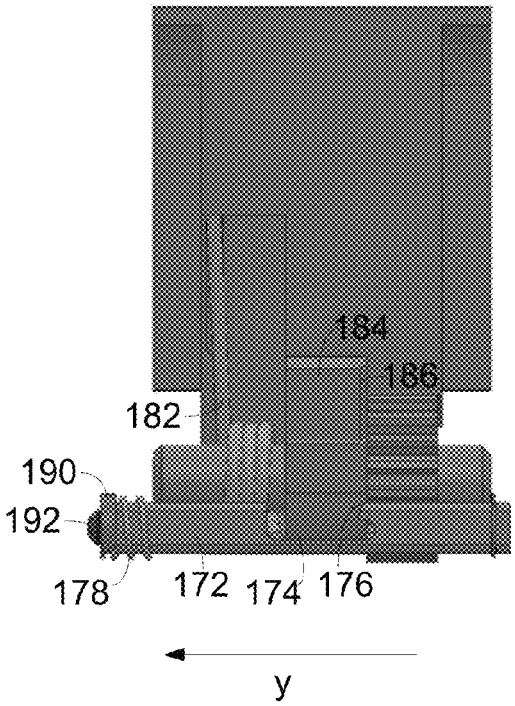
FIG. 27 is a side view of a footrest assembly without a housing according to the second embodiment, wherein the footrest assembly is in a closed configuration.

The overall operation of the footrest assembly 110 will now be described with reference to FIGS. 27 through 29. The default configuration of the footrest assembly 110 is the closed configuration shown in FIG. 27. Again, this is because the biasing apparatus 182 biases the first pedal 112*a* towards the closed configuration. When a user desires to use a footrest, he or she pushes downward on one of the pedals 112*a*, 112*b*. For example, a user may simply place a foot on a pedal 112*a*, 112*b* so that the weight of the foot forces the pedals 112*a*, 112*b* to move downward.

Figure 28:
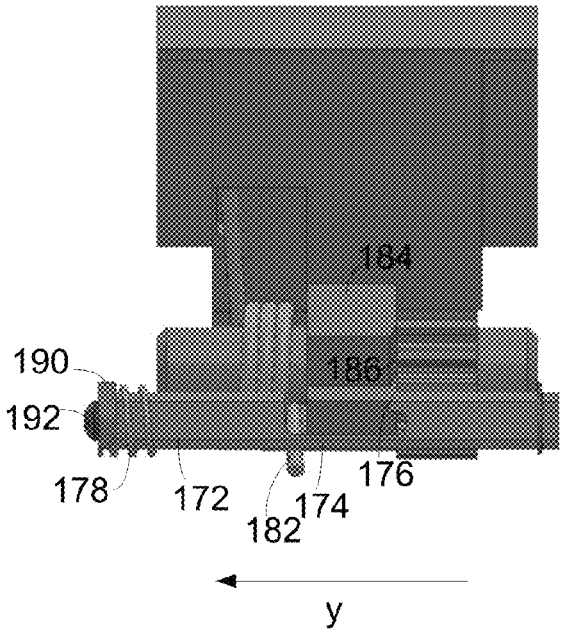
FIG. 28 is a side view of a footrest assembly without a housing according to the second embodiment, wherein the footrest assembly is in between a closed configuration and an open configuration.
Figure 29:
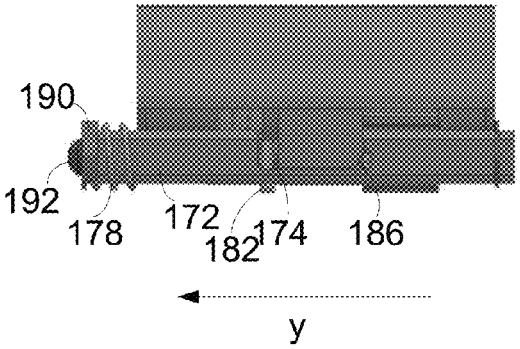
FIG. 29 is a side view of a footrest assembly without a housing according to the second embodiment, wherein the footrest assembly is in an open configuration.

Referring to FIG. 28, as the first pedal 112*a* moves downward, the protrusion engaging surface 186 moves closer to the bellow engaging surface 176 until the surfaces 176, 186 contact one another. As the surfaces 176, 186 contact one another, the protrusion engaging surface 186 slides downward along the bellow engaging surface 176. This sliding engagement causes the bellow engaging surface 176 (and thus the lever 172) to move rearward against the biasing direction y.

The user continues to push downward on one of the pedals 112*a*, 112*b* (and the lever 172 continues to move rearward) until the bellow engaging surface 176 slides past the protrusion engaging surface 186 and reaches the receiving aperture 188. The bellow engaging surface 176 then snaps or otherwise locks into the receiving aperture 188, as shown in FIG. 29. The forward biasing of the lever 172 pushes the bellow engaging surface 176 into the receiving aperture 188 and thus locks the footrest assembly 110 in the open configuration. A user then uses the footrest assembly 110 to rest his or her feet while it is in this open configuration of FIG. 29.

When a user is done using the stylist chair and desires to exit the chair, he or she positions his or her hands on the lever knob 190 and pushes the lever 172 rearward against the forward biasing direction y. The lever is pushed rearward until the bellow engaging surface 176 moves out of and away from the receiving aperture 188. At this point, the biasing apparatus 182 of the first pedal 112*a* biases the pedals 112*a*, 112*b* upward and back the default closed configuration shown in FIG. 27. Thus, a user simply pushes the lever 172 rearward until the pedals 112*a*, 112*b* unlock from the open configuration of FIG. 29 and revert back to the closed configuration of FIG. 27.

What is claimed is:

1. A stylist chair, comprising:

a chair;

a center bar; and a footrest assembly, wherein the center bar couples the footrest assembly to the chair, and wherein the footrest assembly comprises a gear assembly, a first pedal and a second pedal, wherein the first pedal and the second pedal move between an open configuration and a closed configuration, wherein in the open configuration, the first pedal and the second pedal are moved away from one another to form a footrest, wherein in the closed configuration, the first pedal and the second pedal are moved toward one another; and wherein the first pedal and the second pedal are coupled to the gear assembly so that when one of the first pedal and the second pedal moves, the other of the first pedal and the second pedal simultaneously moves.

2. The stylist chair of claim 1 wherein the gear assembly comprises a first gear and a second gear, wherein the first gear and the second gear engage with and cooperate with one another.

3. The stylist chair of claim 2 wherein each the first gear and the second gear engage with one another such that when one of the first gear or the second gear turns clockwise, the other of the first gear or the second gear turns counterclockwise.

4. The stylist chair of claim 2 wherein the each the first gear and the second gear comprises a plurality of teeth, wherein the plurality of teeth of the first gear engages with the plurality of teeth of the second gear to cause the first gear and the second gear to cooperate with one another.

5. The stylist chair of claim 2 wherein each the first gear and the second gear comprises a distal edge, a plurality of teeth, and a proximal edge, wherein the distal edge of the first gear abuts the distal edge of the second gear to hold the first pedal and the second pedal in the open configuration, wherein the proximal edge of the first gear abuts the proximal edge of the second gear to hold the first pedal and the second pedal in the closed configuration, and wherein the plurality of teeth allow the first gear and the second gear to simultaneously move from the open configuration to the closed configuration or from the closed configuration to the open configuration.

6. The stylist chair of claim 1 wherein the first pedal and the second pedal move forward towards the open configuration and rearward towards the closed configuration.

7. The stylist chair of claim 1 wherein the first pedal and the second pedal move downward towards the open configuration and upward towards the closed configuration.

8. The stylist chair of claim 1 wherein the footrest assembly further comprises a biasing apparatus that biases the first pedal and the second pedal towards the closed configuration and wherein a user applies force to one of the first pedal or the second pedal to move the first pedal and the second pedal towards the open configuration.

9. The stylist chair of claim 1 wherein the footrest assembly further comprises a locking assembly, wherein the locking assembly is configured to lock the first pedal and the second pedal in the open configuration and also to release the first pedal and the second pedal from the open configuration.

10. A stylist chair, comprising:

a chair;

a center bar; and a footrest assembly, wherein the center bar couples the footrest assembly to the chair, and wherein the footrest assembly comprises:

a gear assembly;

a first pedal; and a second pedal;

wherein the gear assembly comprises a first gear and a second gear, wherein the first pedal is coupled to the first gear and the second pedal is coupled to the second gear; wherein the first gear and the second gear engage with and cooperate with one another so that when one of the first pedal or the second pedal moves, the other of the first pedal and the second pedal simultaneously moves; and wherein the first pedal and the second pedal move between an open configuration and a closed configuration, wherein in the open configuration, the first pedal and the second pedal are moved forward and away from one another form a footrest that extends outward from the center bar, and wherein in the closed configuration, the first pedal and the second metal are moved rearward and toward one another.

11. The stylist chair of claim 10 wherein each the first gear and the second gear engage with one another such that when one of the first gear or the second gear turns clockwise, the other of the first gear or the second gear turns counterclockwise.

12. The stylist chair of claim 10 wherein the each the first gear and the second gear comprises a plurality of teeth, wherein the plurality of teeth of the first gear engages with the plurality of teeth of the second gear to cause the first gear and the second gear to engage with and cooperate with one another.

13. The stylist chair of claim 12 wherein the plurality of teeth of the first gear comprises peaks and the plurality of teeth of the second gear comprises grooves, wherein the peaks mate within the grooves.

14. The stylist chair of claim 10 wherein each the first gear and the second gear comprises a distal edge, a plurality of teeth, and a proximal edge, wherein the distal edge of the first gear abuts the distal edge of the second gear to hold the first pedal and the second pedal in the open configuration, wherein the proximal edge of the first gear abuts the proximal edge of the second gear to hold the first pedal and the second pedal in the closed configuration, and wherein the plurality of teeth allow the first gear and the second gear to simultaneously move from the open configuration to the closed configuration or from the closed configuration to the open configuration.

15. A stylist chair, comprising:

a chair;

a center bar; and a footrest assembly, wherein the center bar couples the footrest assembly to the chair, and wherein the footrest assembly comprises:

a gear assembly;

a first pedal;

a second pedal; and a lever;

wherein the first pedal and the second pedal move between an open configuration and a closed configuration, wherein in the open configuration, the first pedal and the second pedal form a footrest that extends outward from the center bar, and wherein the first pedal and the second pedal are coupled to the gear assembly so that when one of the first pedal or the second pedal moves, the other of the first pedal or the second pedal simultaneously moves;

wherein the first pedal comprises a top surface and a bottom surface, wherein the top surface defines a footrest surface and the bottom surface comprises a recess and a protrusion, wherein the recess houses a first biasing apparatus that biases the first pedal in an upward direction towards the closed configuration, and wherein the protrusion includes a protrusion engaging surface and a receiving aperture;

wherein the lever comprises a second biasing apparatus, a bellow, and a bellow engaging surface, wherein the second biasing apparatus biases the lever in a frontward direction y;

wherein when a user applies force to either the first pedal or the second pedal to move the first pedal in a downward direction towards the open configuration, the protrusion engaging surface on the protrusion engages with the bellow engaging surface on the bellow, thereby causing the lever to move in a rearward direction until the bellow engaging surface is received by the receiving aperture; and wherein when a user applies force to the lever to move the lever in the rearward direction, the bellow engaging surface is released by the receiving aperture, thereby causing the first biasing apparatus to bias the first pedal in the upward direction towards the closed configuration.

16. The stylist chair of claim 15 wherein the gear assembly comprises a first gear and a second gear, wherein the first gear and the second gear engage with and cooperate with one another.

17. The stylist chair of claim 16 wherein the each the first gear and the second gear comprises a plurality of teeth, wherein the plurality of teeth of the first gear engages with the plurality of teeth of the second gear to cause the first gear and the second gear to cooperate with one another.

18. The stylist chair of claim 17 wherein the plurality of teeth of each the first gear and the second gear comprises alternating peaks and grooves.

19. The stylist chair of claim 16 wherein each the first gear and the second gear have a circular structure, and wherein when one of the first gear or the second gear turns clockwise, the other of the first gear or the second gear turns counterclockwise.

20. The stylist chair of claim 15 wherein the protrusion engaging surface and the bellow engaging surface slidably engage with one another.

21. The stylist chair of claim 15 wherein the protrusion engaging surface and the bellow engaging surface slidably are both slanted at the same angle.

* * * * *